US009691244B2

(12) United States Patent
Weng

(10) Patent No.: US 9,691,244 B2
(45) Date of Patent: Jun. 27, 2017

(54) MULTI-FUNCTIONAL SELF-DEFENSIVE SPRAYING DEVICE

(71) Applicant: Ying-Chun Weng, Taipei (TW)

(72) Inventor: Ying-Chun Weng, Taipei (TW)

( * ) Notice: Subject to any disclaimer, the term of this patent is extended or adjusted under 35 U.S.C. 154(b) by 83 days.

(21) Appl. No.: 14/820,824

(22) Filed: Aug. 7, 2015

(65) Prior Publication Data

US 2017/0039831 A1 Feb. 9, 2017

(51) Int. Cl.

| | |
|---|---|
| ***B05B 15/00*** | (2006.01) |
| ***G08B 15/02*** | (2006.01) |
| ***F41H 13/00*** | (2006.01) |
| ***F41H 9/10*** | (2006.01) |
| ***G08B 15/00*** | (2006.01) |
| ***B05B 7/24*** | (2006.01) |
| ***B05B 12/08*** | (2006.01) |

(52) U.S. Cl.

CPC ..... *G08B 15/02* (2013.01); *B05B 7/2408* (2013.01); *B05B 12/085* (2013.01); *B05B 15/00* (2013.01); *F41H 9/10* (2013.01); *F41H 13/00* (2013.01); *G08B 15/004* (2013.01)

(58) Field of Classification Search

CPC ..... B05B 15/00; B05B 7/2408; B05B 12/085; G08B 15/02; G08B 15/004; F41H 9/10; F41H 13/00

USPC ..... 239/69, 71, 72, 289, 302, 337

See application file for complete search history.

(56) References Cited

U.S. PATENT DOCUMENTS

2012/0298776 A1* 11/2012 Yu ..... F41H 9/10 239/311
2014/0263445 A1* 9/2014 Rowlett ..... F41H 9/10 222/135
2015/0133072 A1* 5/2015 Jang ..... H04M 1/72536 222/192

* cited by examiner

*Primary Examiner* — Steven J Ganey

(57) ABSTRACT

The present invention provides a multi-functional self-defensive spraying device comprising mainly a main body and a bottle body embedded in the main body. On the main body are disposed a control circuit composed of a microprocessor, an alarm module, a voice recognition module, an emitting module, and a GPS module, and a button connected to the control circuit. Inside the bottle body is disposed an internal pocket for housing chemical agents and in the internal pocket is disposed a high pressure gas cylinder. A string connects the high pressure gas cylinder to a pull ring exposed at an outer edge of the bottle body. At a top edge of the bottle body is disposed a nozzle head. When under attack, a user may press the nozzle head therefrom chemical agents will be sprayed to scare and deter the attacker. Also, when a user presses the button or shouts a particular sound, an alarm sound will be emitted and a rescue unit such as the police office will be notified of the attack and the whereabouts of the user. During an emergency, a user may remove the bottle body and pull the pull ring outwards to release pressure from the high pressure gas cylinder, causing the chemical agents to break through the top end of the internal pocket and the nozzle head. The user may speedily escape when the chemical agents are thus dispersed as in an explosion.

4 Claims, 6 Drawing Sheets

MULTI-FUNCTIONAL SELF-DEFENSIVE SPRAYING DEVICE

BACKGROUND OF THE INVENTION

1. Field of the Invention

The present invention relates to a multi-functional self-defensive spraying device, and particularly to a multi-functional self-defensive spraying device which may be used to scare and deter attackers and notify rescue units when a user is under attack and which may disperse chemical agents as in an explosion during an emergency to facilitate the user's speedy escape.

2. Description of Related Art

Rapid changes in our society and economic developments have caused the crime rate to rise. Consequently, when going home at night or walking on empty streets, women tend to be worried about their own personal safety. Some women may purchase self-defensive sprays to scare and deter evil-doers when under attack. However, existing self-defensive sprays on the market need to be aimed precisely at the attacker and pressed at the nozzle head to spray chemical agents in the attacker's face. When the situation is quite urgent and when it is difficult to aim at the attacker, self-defensive sprays may not be of any use. Further, conventional self-defensive spray may only emit chemical agents; they do not provide the functions of raising alarm and positioning, and therefore may not summon prompt rescue. In view of this, after laborious research and experiments, the applicant has devised a multi-functional self-defensive spraying device which may be used to scare and deter attackers and which may disperse chemical agents as in an explosion during an emergency to facilitate the user's speedy escape.

SUMMARY OF THE INVENTION

It is a primary purpose of the present invention to provide a multi-functional self-defensive spraying device which may be used to scare and deter attackers and notify rescue units when a user is under attack and which may disperse chemical agents as in an explosion during an emergency to facilitate the user's speedy escape.

The foregoing multi-functional self-defensive spraying device comprises a main body and a bottle body embedded in the main body. On the main body are disposed a control circuit composed of a microprocessor, an alarm module, a voice recognition module, an emitting module, and a GPS module, and a button connected to the control circuit. Inside the bottle body is disposed an internal pocket for housing chemical agents and in the internal pocket is disposed a high pressure gas cylinder. A string connects the high pressure gas cylinder to a pull ring exposed at an outer edge of the bottle body. At a top edge of the bottle body is disposed a nozzle head. When under attack, a user may press the nozzle head therefrom chemical agents will be sprayed to scare and deter the attacker. Also, when a user presses the button or shouts a particular sound, an alarm sound will be emitted and a rescue unit such as the police office will be notified of the attack and the whereabouts of the user. During an emergency, a user may remove the bottle body and pull the pull ring outwards to release pressure from the high pressure gas cylinder, causing the chemical agents to break through the top end of the internal pocket and the nozzle head. The user may speedily escape when chemical agents are thus dispersed as in an explosion. The present invention may also be of use when a calamity or a mountaineering disaster has happened to a user, or when a user is not feeling well or gets lost while climbing mountain.

The foregoing multi-functional self-defensive spraying device, wherein on the main body is disposed a control circuit which is composed of a microprocessor, an alarm module, a voice recognition module, an emitting module, a GPS module, and a sounding component (a horn or a buzzer).

The foregoing multi-functional self-defensive spraying device, wherein inside the bottle body is disposed an internal pocket for housing chemical agents under high pressure. On a top edge of the bottle body is disposed a nozzle head connected to the internal pocket.

DETAILED DESCRIPTION OF THE PREFERRED EMBODIMENTS

Figure 1:
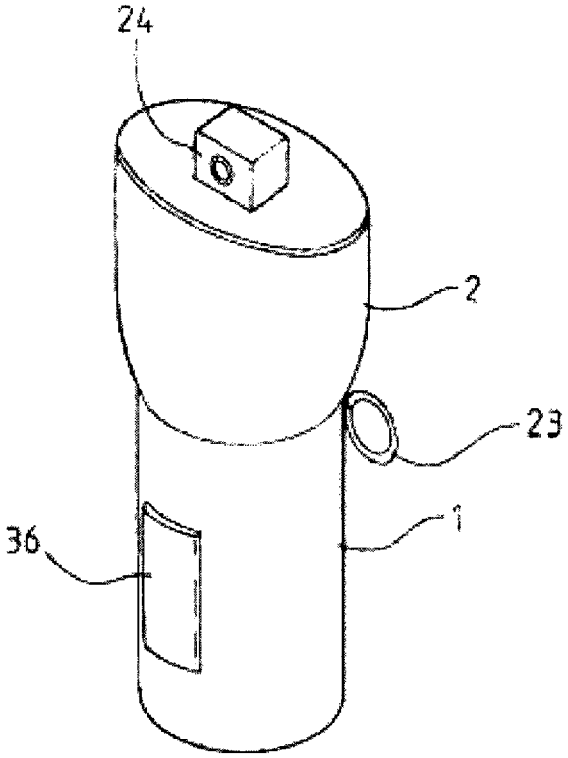
FIG. 1 is a three-dimensional view of the present invention.
Figure 2:
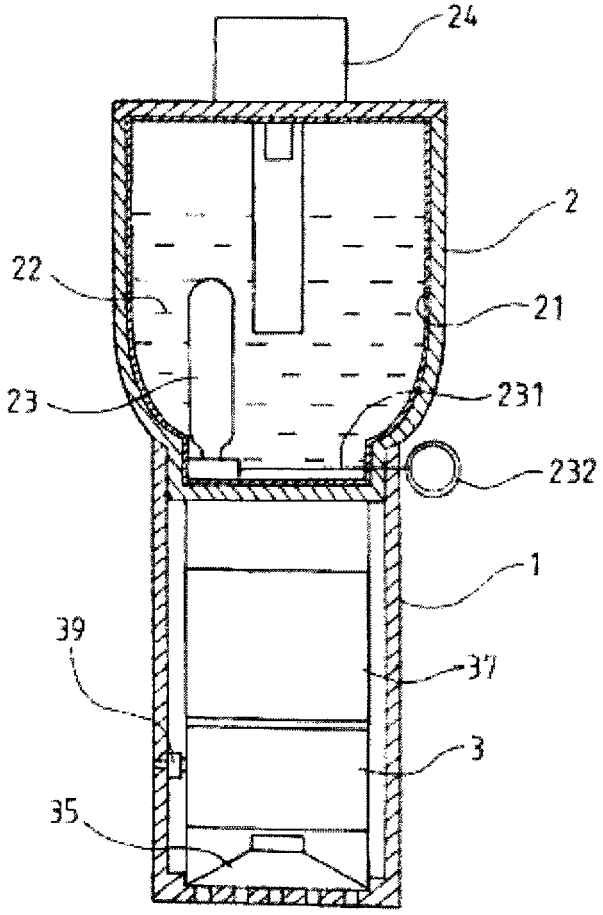
FIG. 2 is a cut-away view of the present invention.
Figure 3:
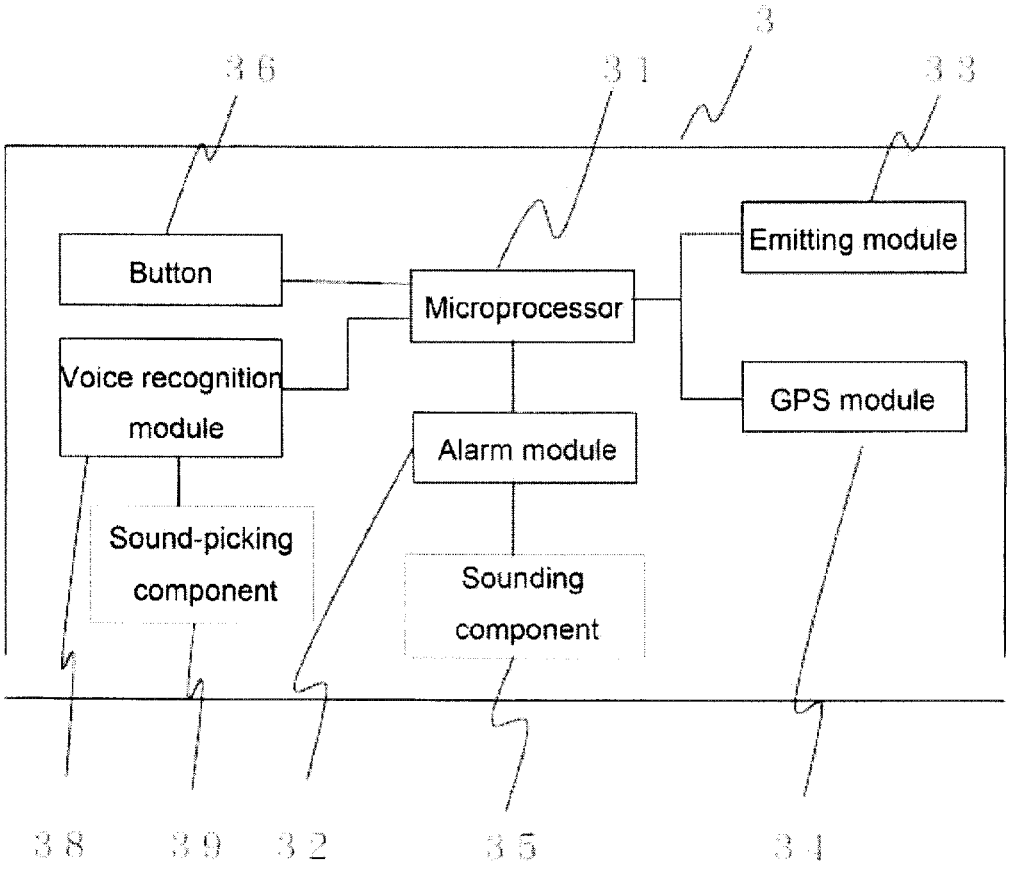
FIG. 3 is a block diagram of an electric circuit of the present invention.

Please refer both to FIG. 1 and FIG. 2, along with FIG. 3, illustrating respectively a three-dimensional view and a cut-away view of the present invention, and a block diagram of an electric circuit of the present invention. As the figures show, the present invention comprises a main body 1 and a bottle body 2 embedded in the main body 1. On the main body 1 are disposed a control circuit 3 composed of a microprocessor 31, an alarm module 32 connected to the microprocessor 31, an emitting module 33, a GPS module 34, and a sounding component (a horn or a buzzer) 35, and a button 36 exposed at an appropriate place on the main body 1. The control circuit 3 is powered by a battery 37, which may be arranged as rechargeable. To the control circuit 3 is also connected a voice recognition module 38, which is connected to a sound-picking component (a bug mic) 39.

Inside the bottle body 2 is disposed an internal pocket 21 for housing chemical agents 22 under high pressure and a high pressure gas cylinder 23. A string 231 connects the high pressure gas cylinder 23 to a pull ring 232 exposed at an outer edge of the bottle body 2. At a top edge of the bottle body 1 is disposed a nozzle head 24 connected to the internal pocket 21. In normal condition, when the pull ring 232 is not pulled, the chemical agents 22 in the high pressure gas cylinder 23 are stored by means of the covering of the internal pocket 21. In the present embodiment, the chemical agents 22 are pungent spray, pepper liquid, or tear gas.

The above-mentioned components are combined to form a multi-functional self-defensive spraying device. When under attack, a user may press the nozzle head 24 therefrom chemical agents will be sprayed to scare and deter the attacker. Also, when a user presses the button 36 or shouts a particular sound, the voice recognition module 38 may identify the sound and the microprocessor 31 will trigger the sounding component 35 to give out a high decibel alarm sound as a warning to attract the attention of people around who may promptly offer help. The microprocessor 31 may also trigger the emitting module 33 to send a distress signal to a rescue unit such as the police office, families and friends (via communication network such as GSM). The GPS module 34 may further transmit a positioning search signal to position the whereabouts of the user via GPS so that the rescue unit may arrive speedily to the spot for rescue following the distress signal and the positioning of GPS. The present invention may also be of use when a calamity or a mountaineering disaster has happened to a user, or when a user is not feeling well or gets lost while climbing mountain.

During an emergency, a user may remove the bottle body 2 from the main body 1 and pull the pull ring 232 on an outer edge of the bottle body 2 outwards to release pressure from the high pressure gas cylinder 23, causing the chemical agents 22 to break through the internal pocket 21 and the bottle body 2 and to disperse as in an explosion. The chemical agents 22 will then fill the surrounding air to keep the attacker away so that the user may speedily escape.

Figure 4:
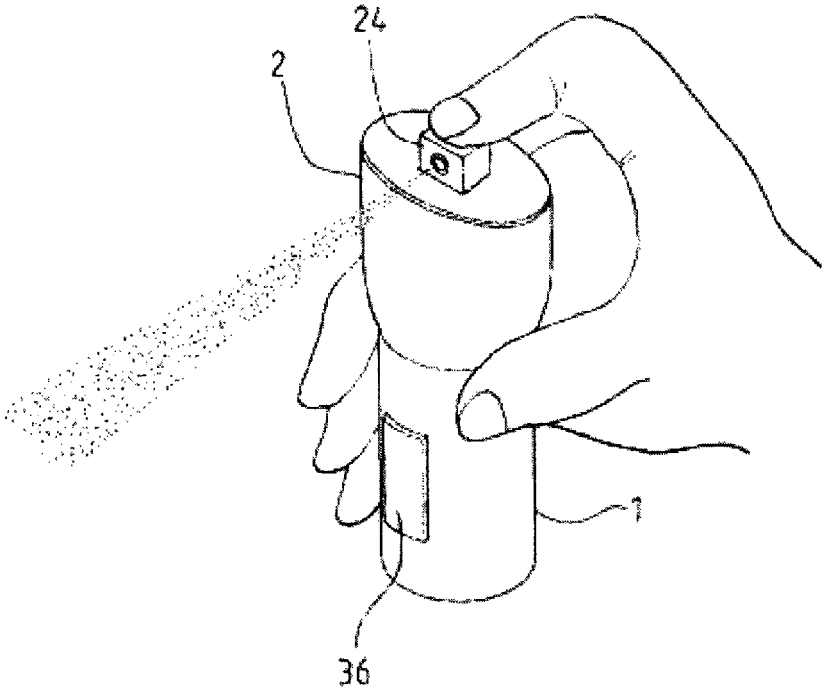
FIG. 4 illustrates the present invention spraying chemical agents.

Please refer to FIG. 4, illustrating the present invention spraying chemical agents. Please also refer to FIG. 2. As these figures show, when under attack, a user holds the main body 1 and presses the nozzle head 24 disposed on the bottle body 2 with one finger so that the chemical agents 22 inside the internal pocket 21 may spray out from the nozzle head 24 to scare and deter the attacker.

Figure 5:
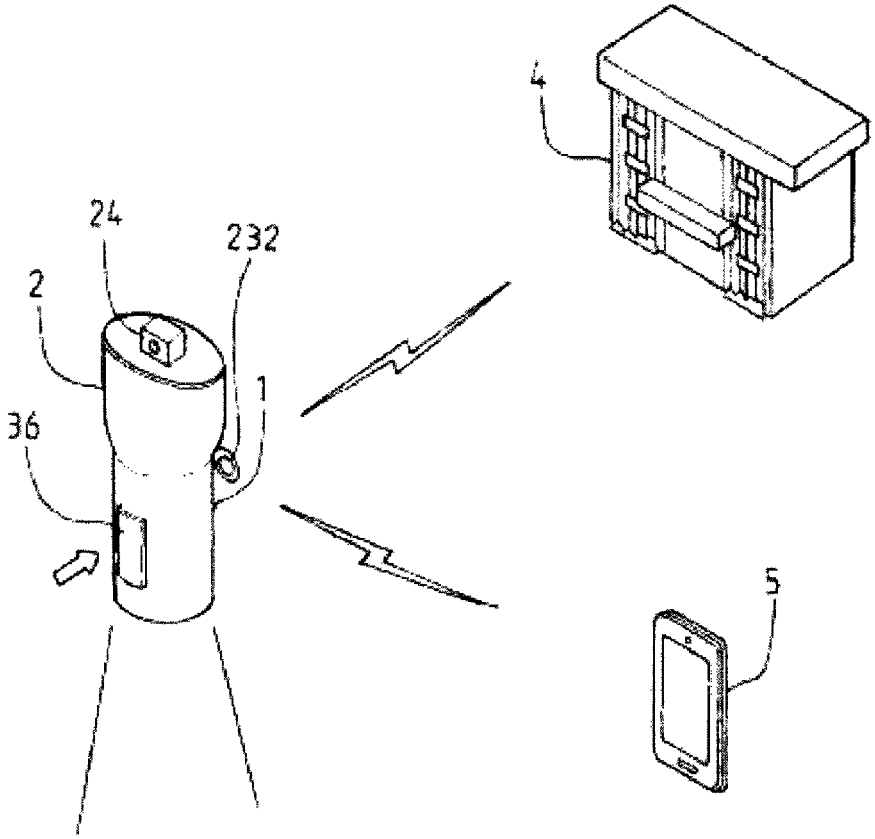
FIG. 5 illustrates the present invention sending off signals.

Please refer to FIG. 5, illustrating the present invention sending off signals. Please also refer to FIG. 2. As these figures show, besides spraying the chemical agents 22 inside the internal pocket 21 from the nozzle head 24 to scare and deter the attacker as is illustrated in FIG. 4, a user may also press the button 36 or shout a particular sound (a particular voice code which is set and saved in advance by the user). The voice code is picked up by the sound-picking component 39 and identified by the voice recognition module 38. Then the microprocessor 31 triggers the sounding component 35 to give out a high decibel alarm sound, and triggers the emitting module 33 to send a distress signal to a rescue unit (transmitted via communication network such as GSM to the police office 4, a mobile phone 5 of a family or friend). The GPS module 34 positions the whereabouts of the user so that the rescue unit may arrive speedily for rescue according to the distress signal and the positioning of GPS.

Figure 6:
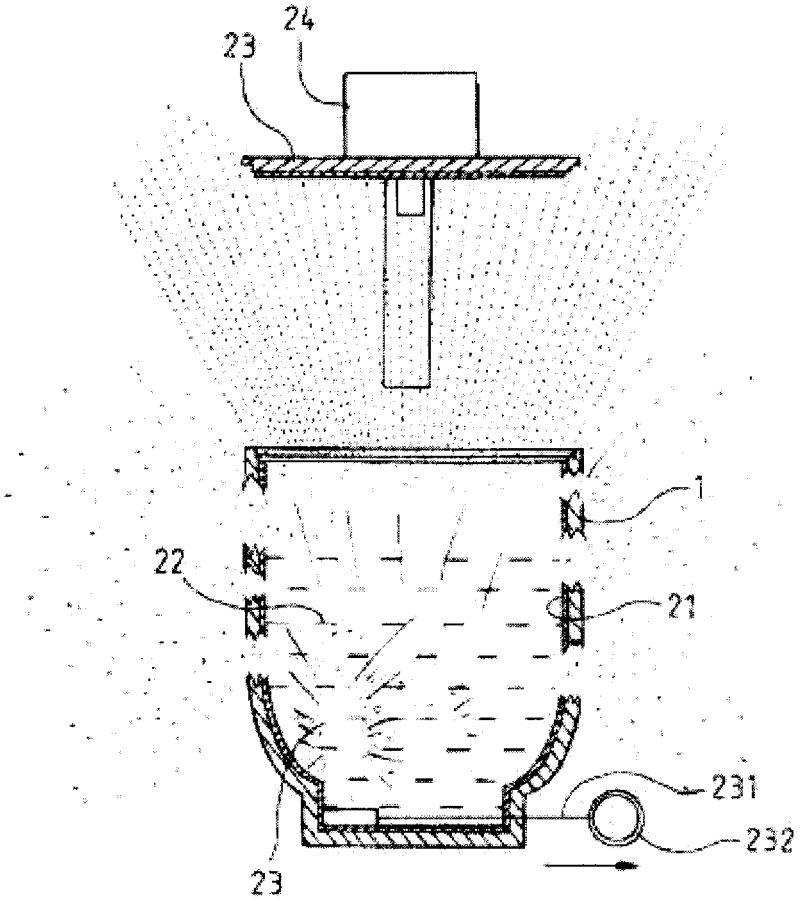
FIG. 6 illustrates the present invention exploding.

Please refer to FIG. 6, illustrating the present invention exploding. Please also refer to FIG. 2. As these figures show, when the situation is quite urgent, and when it is difficult to aim the self-defensive spraying device at the attacker and press the nozzle head 23 properly, a user may remove the bottle body 2 from the main body 1 (pull out the bottle body 2 with some force in a vertical direction) and pull the pull ring 232 outwards to release pressure from the high pressure gas cylinder 23, causing the chemical agents 22 to break through the internal pocket 21 and the bottle body 2 and to disperse as in an explosion. The chemical agents 22 will then fill the surrounding air to keep the attacker away so that the user may speedily escape.

The foregoing preferred embodiment is illustrated of the present invention rather than limiting of the present invention. It is intended to cover various modifications and changes included within the spirit and scope of the appended claims, the scope of which should be accorded the broadest interpretation so as to encompass all such modifications and similar structures.

In view of the foregoing considerations, the present invention provides a multi-functional self-defensive spraying device comprising a bottle body with a nozzle head for housing chemical agents and a main body with a control circuit, which may be used to scare and deter attackers and notify rescue units when a user is under attack and which may disperse chemical agents as in an explosion during an emergency to facilitate the user's speedy escape.

What is claimed is:

1. A multi-functional self-defensive spraying device, comprising:

a main body, thereon is disposed a control circuit composed of a microprocessor, and an alarm module, an emitting module, a GPS module, and a sounding component connected to the microprocessor;

a bottle body embedded at a upper portion in the main body, therein is disposed an internal pocket for housing chemical agents under high pressure and a high pressure gas cylinder, with a string which connects the high pressure gas cylinder to a pull ring exposed at an outer edge of the bottle body and with a nozzle bead disposed at a top edge of the bottle body which connects to the internal pocket; and when under attack, a user may press the nozzle head therefrom chemical agents will be sprayed to scare and deter the attacker and press a button to sound an alarm and a to notify a rescue unit of the attack and the whereabouts of the user; and during an emergency, a user may remove the bottle body and pull the pull ring outwards to release pressure from the high pressure gas cylinder, causing the chemical agents to break through the internal pocket and the bottle body and to disperse as in an explosion so that the user may speedily escape.

2. The multi-functional self-defensive spraying device of claim 1, a wherein the control circuit is connected to the button exposed on the main body which when pressed will start the alarm module, emitting module, and GPS module.

3. The multi-functional self-defensive spraying device of claim 1, wherein the sounding component is a horn or a buzzer.

4. The multi-functional self-defensive spraying device of claim 1, wherein the control circuit of the main body is further connected to a voice recognition module which starts the alarm module, emitting module, and GPS module.

* * * * *